US005256527A

United States Patent [19]

Chari et al.

[11] Patent Number: 5,256,527

[45] Date of Patent: Oct. 26, 1993

[54] STABILIZATION OF PRECIPITATED DISPERSIONS OF HYDROPHOBIC COUPLERS

[75] Inventors: Krishnan Chari; James T. Beck, both of Rochester, N.Y.

[73] Assignee: Eastman Kodak Company, Rochester, N.Y.

[21] Appl. No.: 756,954

[22] Filed: Sep. 9, 1991

Related U.S. Application Data

[62] Division of Ser. No. 544,720, Jun. 27, 1990, Pat. No. 5,087,544.

[51] Int. Cl.[5] ..... G03C 7/388

[52] U.S. Cl. ..... 430/449; 430/493; 430/543; 430/546; 430/553; 430/558; 430/627; 430/630; 430/631; 430/636

[58] Field of Search ..... 252/363.5, 364; 430/543, 546, 553, 558, 627, 630, 631, 449, 493

[56] References Cited

U.S. PATENT DOCUMENTS

| | | | |
|---|---|---|---|
| 2,870,012 | 1/1959 | Godowsky et al. | 430/546 |
| 3,449,123 | 6/1969 | Kondo et al. | 430/545 |
| 3,649,287 | 3/1972 | DePauw et al. | 430/377 |
| 3,658,546 | 4/1972 | Van Doorselaer et al. | 430/517 |
| 3,730,726 | 5/1973 | Tsuji et al. | 430/381 |
| 3,860,425 | 1/1975 | Ono et al. | 430/546 |
| 3,912,517 | 10/1975 | Van Poucke et al. | 430/546 |
| 3,963,449 | 6/1976 | Shiba et al. | 430/505 |
| 4,140,530 | 2/1979 | Trunley et al. | 430/569 |
| 4,211,836 | 7/1980 | Yoneyama et al. | 430/449 |
| 4,275,145 | 6/1981 | Mikami | 430/377 |
| 4,291,113 | 9/1981 | Minamizono et al. | 430/449 |
| 4,379,836 | 4/1983 | Schnoring et al. | 430/449 |
| 4,385,110 | 5/1983 | Yoneyama et al. | 430/372 |
| 4,388,403 | 6/1983 | Helling et al. | 430/546 |
| 4,419,440 | 12/1983 | Kuhnert et al. | 430/377 |
| 4,443,536 | 4/1984 | Lestina | 430/552 |
| 4,490,461 | 12/1984 | Webb et al. | 430/510 |
| 4,933,270 | 6/1990 | Bagchi | 430/546 |
| 4,957,857 | 9/1990 | Chari | 430/546 |
| 4,970,139 | 11/1990 | Bagchi | 430/546 |
| 4,990,431 | 2/1991 | Bagchi et al. | 430/372 |
| 5,008,179 | 4/1991 | Chari et al. | 430/546 |
| 5,013,640 | 5/1991 | Bagchi et al. | 430/546 |
| 5,015,564 | 5/1991 | Chari | 430/546 |
| 5,089,380 | 2/1992 | Bagchi | 430/449 |
| 5,091,296 | 2/1992 | Bagchi et al. | 430/449 |
| 5,104,776 | 4/1992 | Bagchi et al. | 430/449 |
| 5,135,844 | 8/1992 | Bagchi et al. | 430/546 |
| 5,158,863 | 10/1992 | Bagchi et al. | 430/546 |

FOREIGN PATENT DOCUMENTS

| | | |
|---|---|---|
| 0374837 | 6/1990 | European Pat. Off. . |
| 49-74538 | 7/1974 | Japan . |

*Primary Examiner*—Lee C. Wright
*Attorney, Agent, or Firm*—Paul A. Leipold

[57] ABSTRACT

The invention provides stable dispersions of couplers and methods of their formation. The stable dispersions are formed by the use of a nonionic water soluble polymer in combination with an anionic surfactant having a sulfate or sulfonate head group and a hydrophobic group of 8 to 20 carbons. The preferred nonionic water soluble polymers are polyethyleneoxide and polyvinylpyrrolidene. It is preferred that the dispersions have a pH of between about 5 and 5.5.

4 Claims, 5 Drawing Sheets

STABILIZATION OF PRECIPITATED DISPERSIONS OF HYDROPHOBIC COUPLERS

This is a divisional of application Ser. No. 544,720, filed Jun. 27, 1990, now U.S. Pat. No. 5,087,544.

FIELD OF THE INVENTION

The present invention concerns a method for forming stable dispersed particles of photographic components for photographic systems. It particularly relates to the stable dispersion of photographic coupler materials.

PRIOR ART

The art of precipitation of hydrophobic coupler for photographic systems, starting from a solution state, to a stable fine particle colloidal dispersion is known. This is generally achieved by dissolving the coupler in a water-miscible solvent aided by addition of base to ionize the coupler, addition of a surfactant with subsequent precipitation of the photographic component by lowering the pH, or by shift in concentration of the two or more miscible solvents, such that the photographic component is no longer soluble in the continuous phase and precipitates as a fine colloidal dispersion.

In United Kingdom Patent 1,193,349, Townsley et al discloses a process whereby a color coupler is dissolved in a mixture of water-miscible organic solvent and aqueous alkali. The solution of color coupler is then homogeneously mixed with an aqueous acid medium including a protective colloid. Thus was formed a dispersion of precipitated color coupler by shift of pH, and this dispersion of color coupler when mixed with a dispersion of an aqueous silver halide emulsion and coated on a support, was incorporated into a photographic element.

In an article in *Research Disclosure* 16468, December 1977, pages 75-80 entitled "Process for Preparing Stable Aqueous Dispersions of Certain Hydrophobic Materials" by W. J. Priest, published by Industrial Opportunities Ltd., The Old Harbormaster's, 8 North Street Emsworth, Hants P 010 7DD U.K. a method of forming stable aqueous dispersions of hydrophobic photographic material was disclosed. The process of Priest involves the formation of an alkaline aqueous solution of an alkali soluble color-forming coupler compound in the presence of a colloid stabilizer or polymeric latex. The alkali solution is then made more acidic in order to precipitate coupler. The particles of color-forming coupler compounds are stabilized against excessive coagulation by adsorption of a colloid stabilizer.

U.S. Pat. No. 2,870,012—Godowsky et al discloses formation of a finely divided suspension of a coupler by precipitation caused by solvent shift. Also disclosed is utilization of a surfactant that is a dioctyl ester of sodium sulfosuccinic acid as a wetting or dispersing agent. It is indicated in Godowsky et al that the materials are stable for a long period of time after removal of the solvent.

U.S. Pat. No. 4,388,403—Helling et al discloses the formation of dispersions of polymers that are stable for long periods of time and useful in photographic processes.

While all of the above processes have been somewhat successful for some color photographic materials, there remain difficulties in obtaining stable dispersions of couplers having short hydrocarbon chains as ballast groups by condensation from solution. These couplers, unlike those successfully utilized in the prior art, are not stable when left for several days at room temperature after being formed as particle dispersions by solvent and/or pH shifting. The particle sizes increase and the particles may gel or precipitate. There is a need for a method of making such dispersions of these couplers that are stable.

The preparation of laboratory scale batches of precipitated dispersions of hydrophobic color couplers is known in the art (Godowsky and Duane U.S. Pat. No. 2,870,012; Townsley and Trunley G. B. Patent 1,193,349). In an embodiment of the process disclosed in U.S. Ser. No. 288,922 filed Dec. 23, 1988 by Chari, the coupler is dissolved in a mixture comprising aqueous base and a water-miscible organic solvent. The solution of the coupler is then combined with an aqueous solution containing surfactant, and the pH of the mixture is reduced by the addition of aqueous acid to form a suspension of fine particles of the coupler in the medium. The latter is then washed with distilled water to remove the water miscible solvent. While the above process works satisfactorily in the laboratory where the quantity of coupler involved is no more than a few grams, certain difficulties are encountered in the transfer of the process to manufacturing where several kilograms of coupler may be used to make a given batch of dispersion. A major problem is decomposition of the color forming coupler in base. The latter is not usually observed in laboratory scale preparations since the time needed to dissolve small quantities of the coupler in the laboratory is relatively short (typically three or four minutes at room temperature). However, the time taken to dissolve the coupler in large-scale production is significantly longer and there is a need to develop a process that can produce dispersions without degrading the coupler. Furthermore, the products of decomposition of certain couplers are colored and there is concern that these may cause stain in coatings if allowed to build up. It is also necessary to prepare concentrated dispersions of the coupler (greater than 4% w/w in water) for product-scale coatings. The latter involves ultrafiltration to remove water from the dispersion that is initially formed. It is found that the viscosity of the dispersion can rise significantly as a function of concentration thereby affecting the efficiency of the ultrafiltration process and limiting the maximum concentration that can be achieved. The latter is particularly a problem for dispersion of color couplers that contain the carboxylic acid moiety. It is considered possible that the low pKa of this group results in strongly charged dispersion particles even at pH as low as 5.5. The interactions between the charged particles are thought to cause the high viscosity of the dispersion. There is a need to control the viscosity of the dispersion during ultrafiltration.

THE INVENTION

An object of this invention is to overcome disadvantages of prior processes.

An object of this invention is a process for the large-scale manufacture of precipitated dispersions of hydrophobic couplers (yielding in excess of 100 kg of dispersion at a concentration of at least 4% w/w coupler) that results in dispersed coupler that is essentially free of chemical degradation.

A further object of this invention is a process that allows the preparation of concentrated precipitated dispersions having low viscosity (less than 20 cp at a shear rate of 100 reciprocal seconds at 25° C.).

The invention provides a method of forming a stable dispersion of hydrophobic couplers having short hydrocarbon chain ballast groups of up to 15 carbons. The coupler solution is kept below 25° C., and comprises n-propanol in an amount at least about 44 weight percent of the total solution and sodium hydroxide in an amount of less than 35 weight percent of the total solution. This stable dispersion is formed by the use of a nonionic water soluble polymer in combination with an anionic surfactant having a sulfate or sulfonate head group and a hydrophobic group of 8 to 20 carbons. The surfactant further does not have oxyethylene groups. The preferred nonionic water soluble polymers are polyethyleneoxide and polyvinylpyrrolidone. It is preferred that the dispersions have a pH of between about 5 and 5.5. The preferred couplers that form stable dispersions by this system are couplers 1–4 as follows:

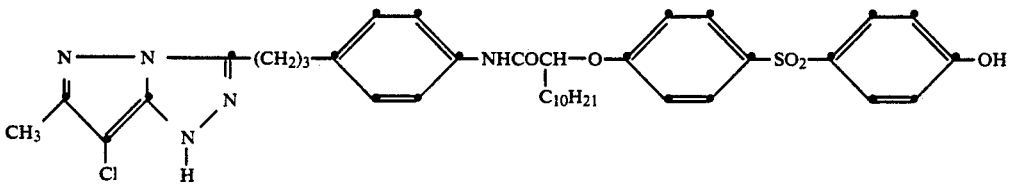

(1)

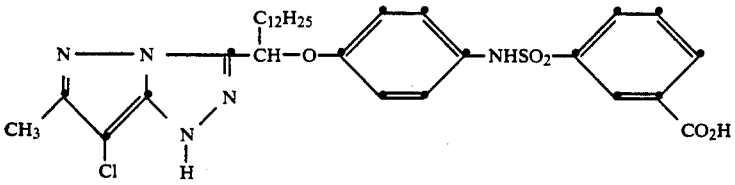

(2)

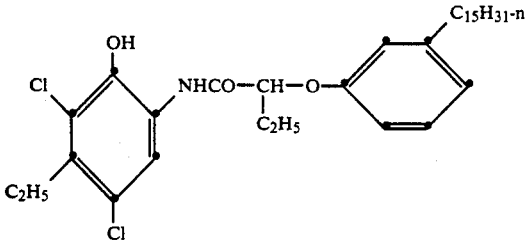

(3)

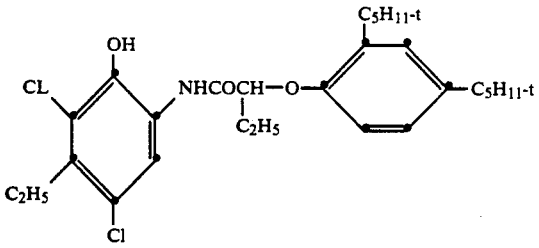

(4)

Other couplers suitable for use in the invention are those having a low pKa group such as carboxylic acid or sulfonamido that may have viscosity problems in dispersion if not formed by the invention process.

MODES OF PERFORMING THE INVENTION

There are numerous advantages in the invention in that the short chain ballasted couplers may now be formed in the small particles available by preparation of colloidal dispersions by condensation techniques. Further, the dispersions formed are stable for longer than three weeks at room temperature without agitation or other special conditions. While it has been known to form storage stable small particle dispersions of other couplers, the couplers of the invention have not been suitably formed as small particle dispersions with good storage properties. The method of the invention allows formation of such small particle dispersions efficiently and at low cost. The method of the invention further provides photographic coatings not stained by degradation products. The dispersions of the invention and their formation method are set forth below.

Generally the invention is performed by forming a basic solvent solution of a short chain ballasted coupler. An aqueous solution of a nonionic water soluble polymer and an anionic surfactant, having a sulfate or sulfonate head group, a hydrophobic group of 8 to 20 carbons and not having oxyethylene groups is also formed. The solvent coupler solution and the aqueous solution, containing the surfactant and nonionic water soluble polymer, are combined and immediately neutralized to a pH of between about 5.0 and 5.5. The basic solvent normally is made a basic solution by the addition of a base, such as sodium hydroxide to a solvent such as an alcohol. After the combination of the solvent and water solutions and neutralization or addition of acid to precipitate the dispersion of solid coupler particles, the dispersion is washed using a dialysis membrane to remove the solvent.

Figure 1:
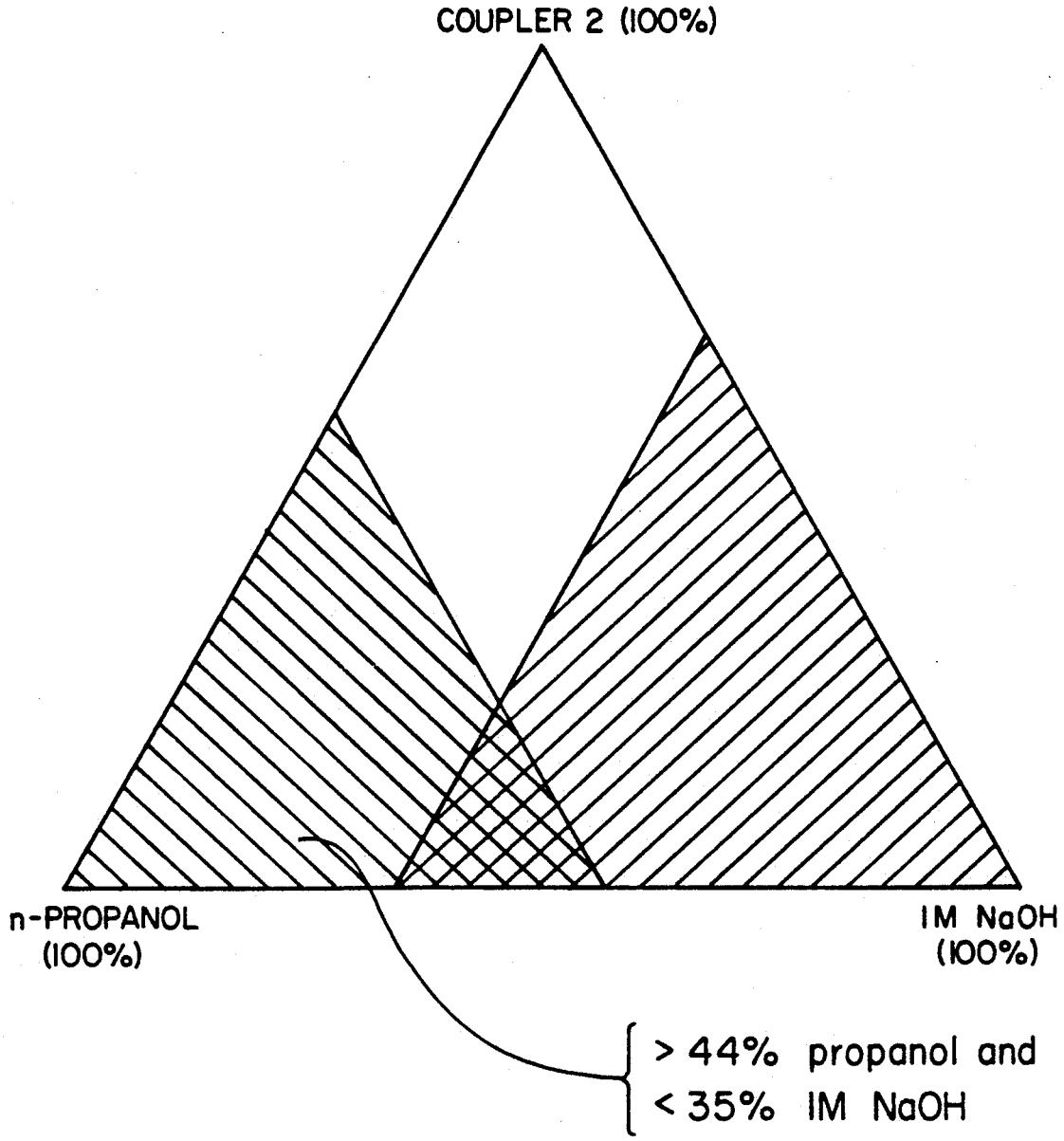
FIG. 1 is a ternary diagram of coupler, sodium hydroxide, and n-propanol concentrations of the invention.

The objective of low degradation is realized by selecting a composition in the ternary system defined by the coupler, organic solvent and aqueous base that is sufficiently low in concentration of base so that decomposition of the coupler is negligible (less than 3%) after the length of time it takes to dissolve the coupler in production. The preferred organic solvent is n-propanol, and the preferred aqueous base is a one molar solution of sodium hydroxide. It is also preferred that the concentration of 1M NaOH in the above three component mixture of coupler, organic solvent and aqueous base is less than 35% w/w and that the concentration of n-propanol in the same mixture is greater than 44% w/w for a dispersion with very little degradation. Furthermore the temperature of the mixture should not exceed 25° C. to provide a low level of degradation of coupler. Illustrated in FIG. 1 is the ternary system of invention illustrated with coupler 2. As can be seen, the desired operating window in the ternary system is quite small.

The objective of low viscosity dispersions is realized by adjusting the pH of the dispersion to less than 5.5 after the dispersion has been washed to remove substantially all the organic solvent and prior to concentrating the dispersion. The preferred value for the pH of the dispersion after washing is 5.2 for low viscosity and stable materials.

The couplers of the invention may be any coupler that is stabilized after preparation as a colloidal dispersion by condensation by the combination of the anionic surfactant and nonionic water soluble polymer of the invention. The couplers suitable for use in the invention are those couplers having short chain hydrocarbon ballast groups. Short chain is used here to mean those hydrocarbon chains of up to 15 carbons. Couplers with which stable dispersions can be formed beneficially in accordance with this invention can be represented by the structure:

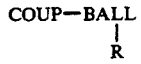

where:

COUP is a coupler moiety,

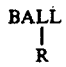

is a ballast group, and

R is a hydrocarbon chain of 2 to 15 carbon atoms.

Typically, R is an unsubstituted alkyl group of 2 to 15 carbon atoms.

The coupler moiety represented by COUP can be any of the coupler moieties known in the art. Typically, COUP is a dye-forming coupler moiety, e.g., a yellow dye-forming coupler moiety such as an acylacetanilide or an aroylmethane, a magenta dye-forming coupler moiety such as a pyrazolone or a pyrazoloazole, or a cyan dye-forming coupler moiety such as a phenol or a naphthol.

The ballast group, BALL-R, is joined to a non-coupling position of the coupler moiety. Representative ballast groups have one of the following structures, where the unsatisfied bond is joined to a non-coupling position of the coupler moiety:

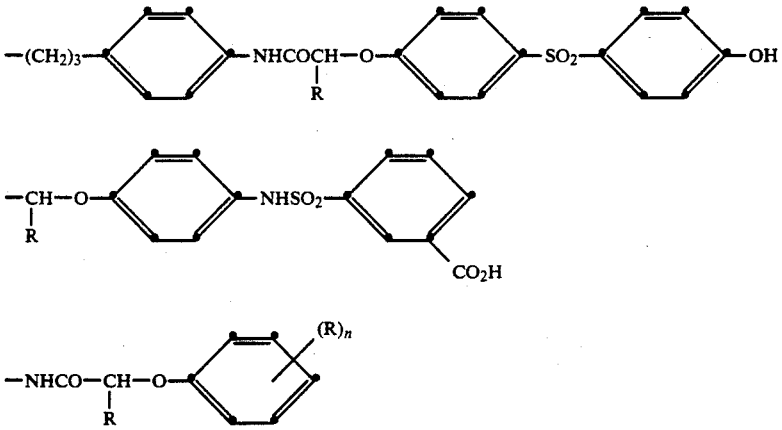

where R is alkyl of 2 to 15 carbon atoms, and n is 1 or 2.

The couplers preferred for the invention in view of their greatly increased stability of dispersion are as follows:

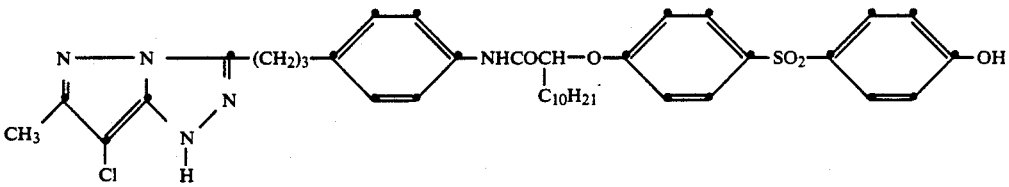

(1)

-continued

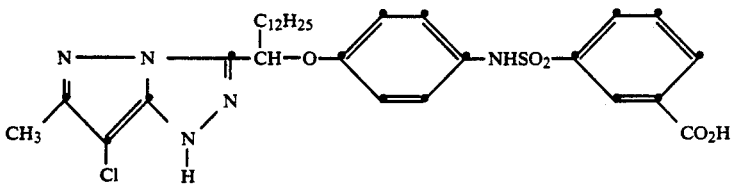

(2)

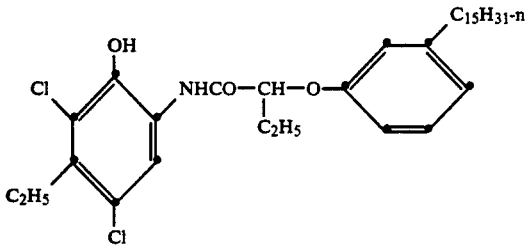

(3)

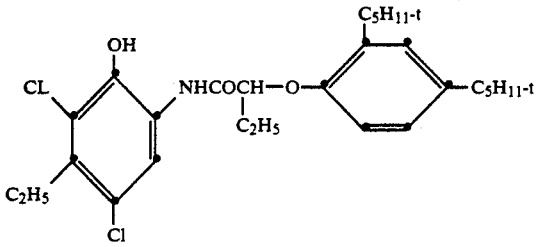

(4)

It can be seen that the ballast chains of these couplers are 10 carbons for 1, 12 carbons for 2, 15 carbons for 3, and 2 chains of 5 carbons for 4.

The water miscible solvent for dissolving the hydrophobic coupler may be any solvent capable of dissolving the coupler without decomposing the coupler. Suitable solvents include methanol, n-propanol, isopropyl alcohol and butyl alcohol.

The surfactants for the invention are any anionic surfactant having a sulfate or sulfonate head group. The head group is the group on the surfactant that extends away from the particle into the water in which the particles disperse. The other portion of the surfactant is a hydrophobic group of 8 to 20 carbons that will lie on the surface of the coupler particle. The surfactant does not have oxyethylene groups which would interfere with forming the stable dispersions of the invention. The sulfate or sulfonate group may be represented as an $SO_3M$ or $OSO_3M$ moiety where M represents a cation. M most commonly is sodium. Typical of surfactants suitable for the invention are those as follows:

$C_{12}H_{25}OSO_3Na$ A-1

$C_{14}H_{29}OSO_3Na$ A-2

$C_{12}H_{25}CONHCH_2CH_2OSO_3Na$ A-3

$C_{12}H_{25}SO_3Na$ A-4

$C_{14}H_{29}SO_3Na$ A-5

$NaO_3S-CH(CH_2COOC_8H_{17})-COOC_8H_{17}$ A-6

A-7

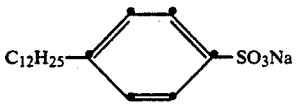

-continued

A-8

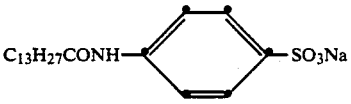

A-9

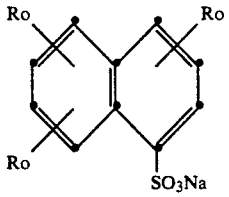

A-10

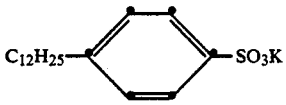

A-11

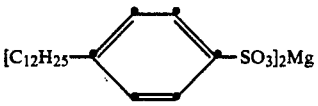

Preferred surfactants of the invention are sodium bis(2 ethyl hexyl) sulfosuccinate, sodium tetradecyl sulfate, sodium dodecyl sulfate and sodium dodecyl benzene sulfonate as they form dispersions that are stable for long periods of time.

The nonionic water soluble polymer utilized in the invention may be any nonionic water soluble polymer that is composed of polar and non-polar groups and is attracted to the head group of the surfactant being utilized and acts with the surfactant to prevent the increase in particle size of the dispersed coupler during storage. Typical of such polymers are polypropylene oxide, polyvinyl alcohol, and methylcellulose. Suitable polymers are polyethylene oxide and polyvinylyrrolidone. The polyvinylpyrrolidone is preferred as it results in the most uniform and storage stable particles.

The base added to the solvent is any material that will be stable in solvent and in water while raising the pH of the solvent solution. A preferred material for the alcohol solvent system of the invention is sodium hydroxide as it is effective in small amounts, stable, and low in cost.

The term "storage stable" as utilized in this invention is intended to mean that dispersions of the invention are stable for at least three weeks when stored at room temperature (about 20° C.) without agitation. The stable dispersions have no settling of material during the three-week storage. The median particle size of the typical dispersion of the invention is between about 8 and about 300 nm.

The following examples are intended to be illustrative of the invention. Parts and percentages are by weight unless otherwise indicated.

Examples 1–3 illustrate only coupler decomposition and the benefit of going to lower pH so as to not decompose coupler.

EXAMPLE 1 (CONTROL)

This example and the next one illustrate the effect of the composition of the ternary mixture comprising the magenta image coupler C2, n-propanol, and 1M NaOH on the decomposition of C2.

Figure 2:
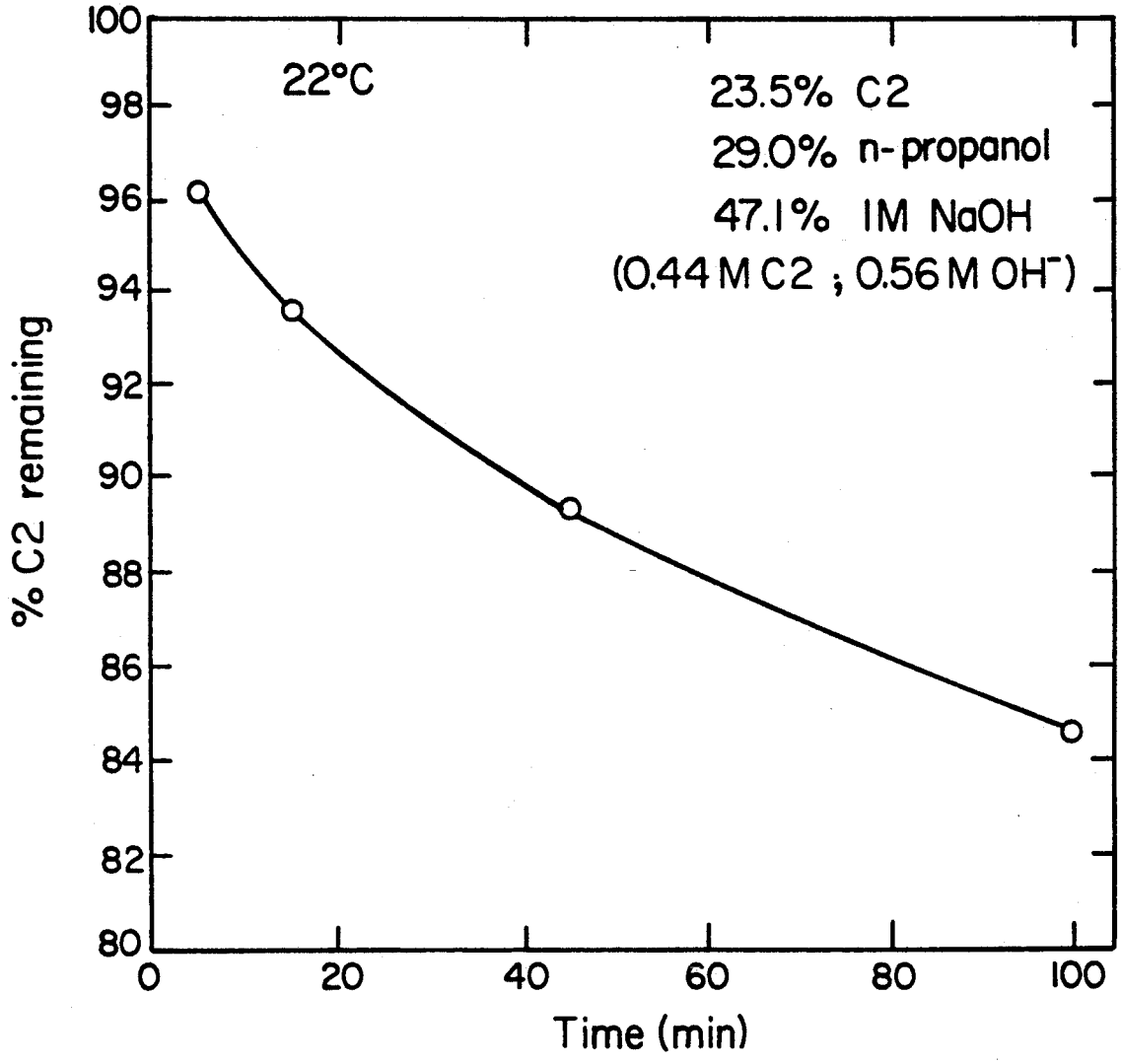
FIGS. 2–5 illustrate the results of the Examples.

Eight grams of C2 was mixed with 10 grams of n-propanol and 16 grams of 1M NaOH at 22° C. The above quantities correspond to a composition of 23.5% w/w C1, 29.4% w/w n-propanol, and 47.1% w/w 1M NaOH for the three component system. The coupler was completely dissolved after 4 minutes. The system was maintained at 22° C. by immersing in a constant temperature water bath, and samples were taken out as a function of time. The samples were analyzed for coupler content by liquid chromatography (LC). The results of the experiment are shown in FIG. 2. It is clear that under these conditions more than 10% of the coupler is lost after 40 minutes.

EXAMPLE 2

This example shows the elimination of the problem of Example 1.

8.2 grams of the coupler C2 was mixed with 18.1 grams of n-propanol and 13.7 grams of 1M NaOH. These quantities correspond to a compositon of 21% w/w C1, 45% w/w n-propanol, and 34% w/w 1M NaOH. As in Example 1, the coupler was completely dissolved after 4 minutes, and the system was maintained at 22° C. by immersing in a constant temperature water bath. It was found that no measurable decomposition could be detected by LC even after 100 minutes.

EXAMPLE 3

This example illustrates the effect of temperature on the decomposition of C2 when C2 is a component of the ternary system comprising C2, n-propanol, and 1M NaOH.

Figure 3:
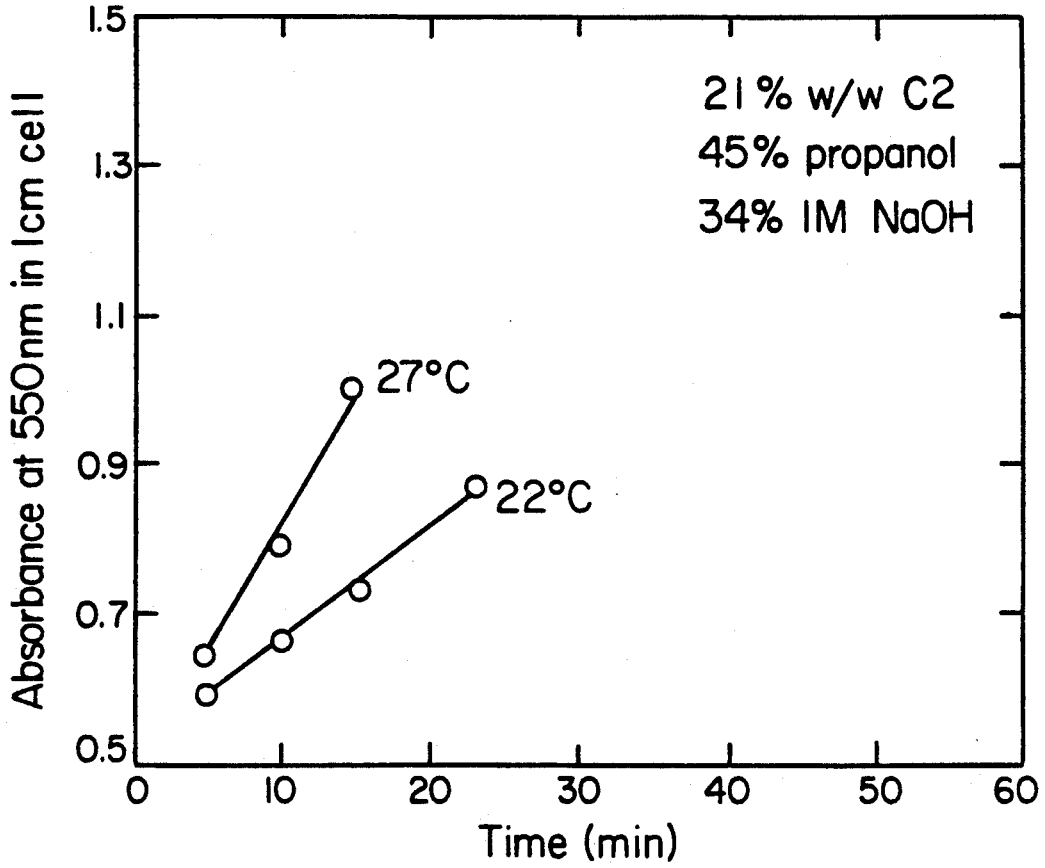

A product of the decomposition of C2 in the above system has an absorption in the visual region of the spectrum with lambda max. at 535 nm. A very small quantity of this decomposition product can give rise to a relatively large absorption, and there is a need to minimize the extent of color formation. FIG. 3 shows the absorbance at 550 nm in a 1 cm cell of the composition in Example 2 as a function of time at two different temperatures. It is clear that the extent of unwanted color formation can be minimized by keeping the mixture at a lower temperature.

EXAMPLE 4

Figure 4:
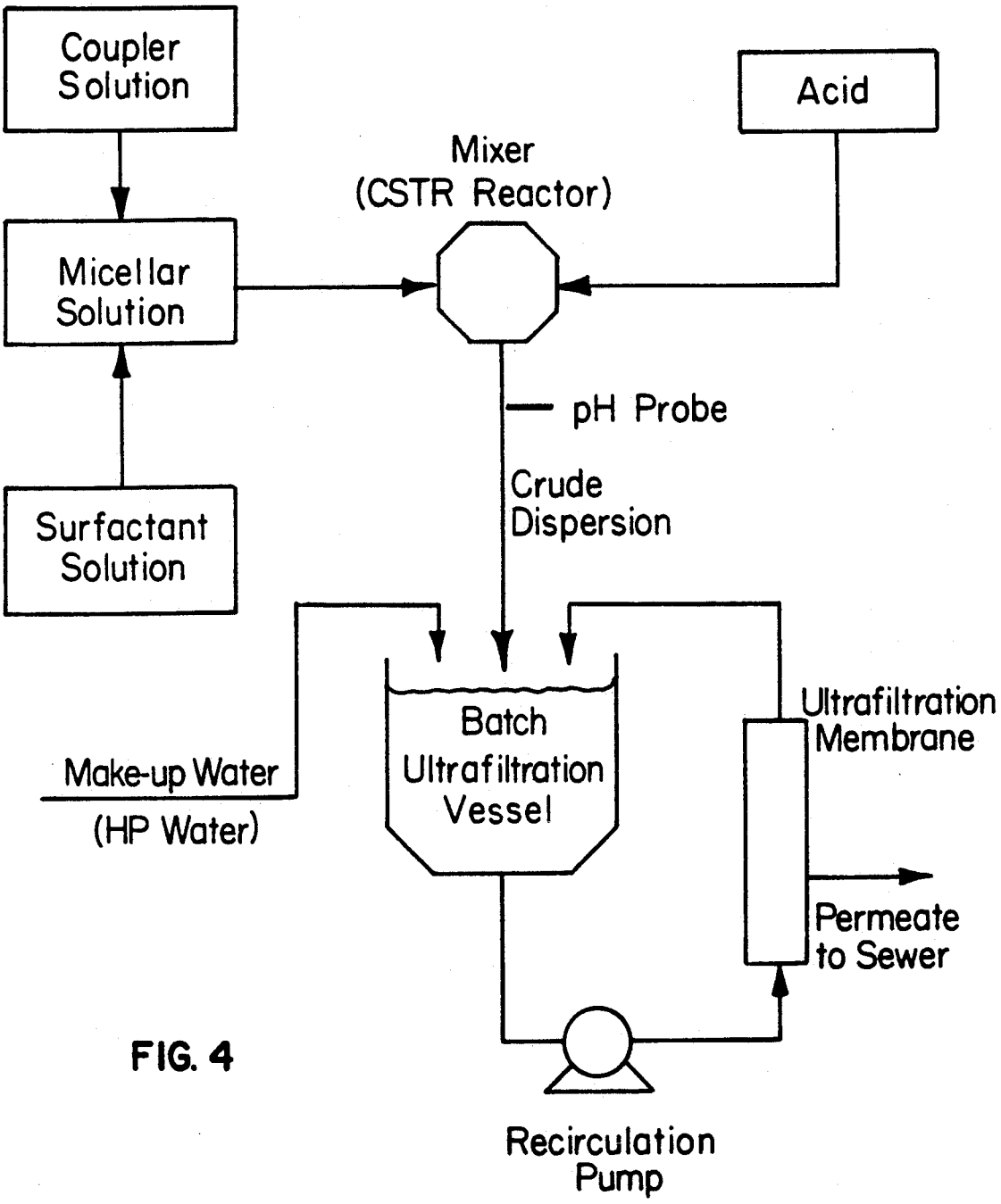

This example illustrates a process for the manufacture of large-scale quantities of a concentrated precipitated dispersion of the coupler C2. A schematic of the process is shown in FIG. 4.

A surfactant solution containing 0.9 kg of Dupanol ME and 4.1 kg of polyvinylpyrrolidone (GAF K-30) in 328.8 kg of high purity water was prepared. 8.2 kg of C2 was dissolved in 18.1 kg of n-propanol and 13.7 kg of 1M NaOH at 25° C. The coupler was completely dissolved in 20 minutes. The surfactant solution was then mixed with the solution of the coupler. We refer to this mixture as the "micellar solution".

The micellar solution was metered into a continuous stirred tank at the rate of 18.4 kg/min. Simultaneously a stream of 15% w/w solution of acetic acid in water was also metered into the continuous stirred tank at the rate of 0.3 kg/min. The rate at which the acid was added was adjusted to give a pH of 5.2 for the crude dispersion leaving the continuous stirred tank.

The crude dispersion was collected in an ultrafiltration vessel and washed for three turnovers with high purity water using an ultrafiltration membrane to remove n-propanol. During the washing process each turnover constitutes a volume of permeate (filtrate) equal to the volume of the dispersion in the ultrafiltration vessel. High purity water (make-up water) is added to the ultrafiltration vessel to maintain constant volume in the vessel during the washing process.

After washing, the pH of the dispersion was once again adjusted to 5.2 using 15% acetic acid solution. The dispersion was then concentrated by pumping through the ultrafiltration device (with no addition of make-up water) to give a final yield of 100 kg of concentrated dispersion at 5.5% coupler. Analysis of the dispersion for decomposition products indicated that less than 3% of the coupler had decomposed. The viscosity of the dispersion was less than 10 cp. The material was stable, without observable precipitation, after 3 weeks' storage at room temperature.

EXAMPLE 5

This example illustrates the effect of the pH of the washed dispersion on the viscosity of the concentrated dispersion.

Figure 5:
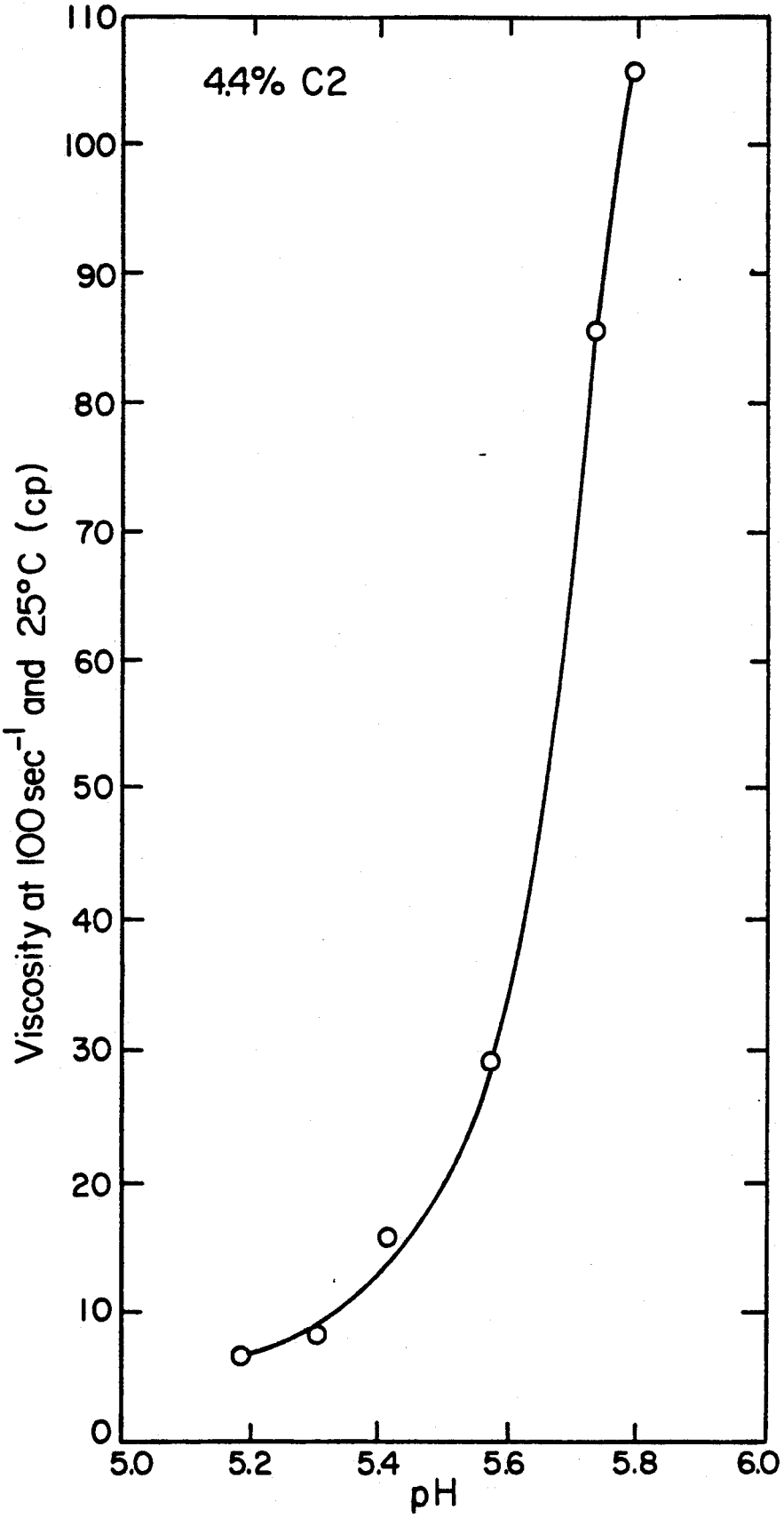

The washed dispersion was prepared in a manner similar to that described in Example 4. The relationship between the viscosity of the concentrated dispersion (4.4% C2 at 25° C. and 100 reciprocal seconds) and the pH of the washed disperion (prior to concentrating) is shown in FIG. 5. It is clear that the viscosity is significantly reduced if the pH of the washed dispersion is adjusted to be below 5.5.

It will be understood that the examples and discussion above are intended to be illustrative only of the invention and that the invention is to be taken as limited only by the scope of the claims attached hereto.

We claim:

1. A storage stable dispersion comprising at a pH of about 5.2, water, particles of a coupler having ballast comprising straight chain hydrocarbons of up to 15 carbon atoms, a surfactant comprising a head group of sulfate or sulfonate and having no oxyethylene groups, 2. The dispersion of claim 1 wherein said coupler comprises a member selected from the group consisting of:

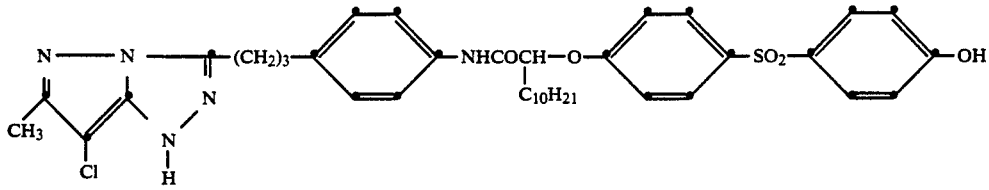

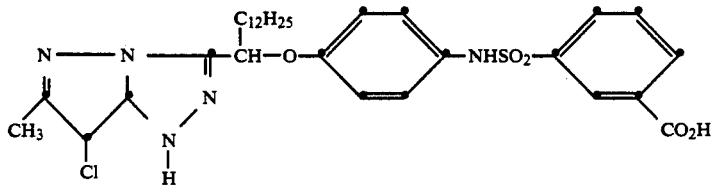

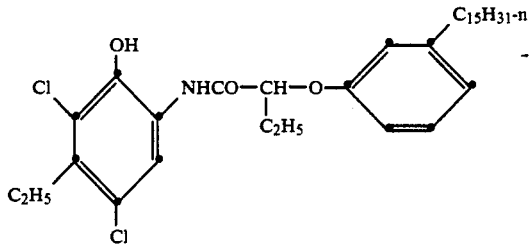

and

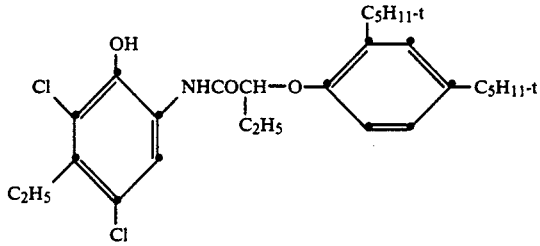

and a nonionic water soluble polymer that is attracted to said surfactant with the proviso that said dispersion has a concentration of at least 4% w/w coupler and a viscosity of less than 20 cp at a shear rate of 100 reciprocal seconds at 25° C.

3. The dispersion of claim 2 wherein said water soluble polymer comprises polyvinylpyrrolidone.

4. The dispersion of claim 3 wherein the median particle size of said coupler particles is between about 8 and about 300 nm.

* * * * *